US010343444B2

(12) United States Patent
Yokochi

(10) Patent No.: US 10,343,444 B2
(45) Date of Patent: Jul. 9, 2019

(54) SHEET PROCESSING APPARATUS AND SHEET PROCESSING METHOD

(71) Applicant: KABUSHIKI KAISHA TOSHIBA, Tokyo (JP)

(72) Inventor: Hidetoshi Yokochi, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/240,635

(22) Filed: Jan. 4, 2019

(65) Prior Publication Data

US 2019/0135022 A1 May 9, 2019

Related U.S. Application Data

(63) Continuation of application No. 15/394,318, filed on Dec. 29, 2016.

(51) Int. Cl.

| | |
|---|---|
| ***B65H 37/04*** | (2006.01) |
| ***B42F 3/04*** | (2006.01) |
| ***B65H 37/02*** | (2006.01) |
| ***B65H 31/02*** | (2006.01) |

(52) U.S. Cl.

CPC ..... *B42F 3/04* (2013.01); *B65H 31/02* (2013.01); *B65H 37/02* (2013.01); *B65H 37/04* (2013.01); *B65H 2301/4212* (2013.01); *B65H 2301/4213* (2013.01); *B65H 2301/5163* (2013.01); *B65H 2405/11151* (2013.01); *B65H 2511/20* (2013.01); *B65H 2801/27* (2013.01)

(58) Field of Classification Search

CPC ..... B65H 37/04
USPC ..... 399/407
See application file for complete search history.

(56) References Cited

U.S. PATENT DOCUMENTS

| | | | | |
|---|---|---|---|---|
| 6,102,097 | A * | 8/2000 | Stennpien | B32B 37/0076 156/230 |
| 6,193,228 | B1 | 2/2001 | Shimao et al. | |
| 6,371,187 | B1 * | 4/2002 | Nowaczyk | G08B 13/2408 156/199 |
| 6,474,387 | B1 * | 11/2002 | Shimao | B07C 5/02 156/364 |
| 9,061,433 | B2 | 6/2015 | Nakamura | |
| 10,203,644 | B2 * | 2/2019 | Endo | G03G 15/6541 |
| 2003/0210943 | A1 * | 11/2003 | Nedblake, Jr. | B41J 11/0015 400/621 |
| 2005/0000336 | A1 | 1/2005 | Hattori et al. | |
| 2006/0118229 | A1 * | 6/2006 | Ohashi | G06K 19/077 156/60 |

(Continued)

FOREIGN PATENT DOCUMENTS

JP 2016-148018 A 8/2016

*Primary Examiner* — Anthony H Nguyen
(74) *Attorney, Agent, or Firm* — Kim & Stewart LLP

(57) ABSTRACT

A sheet processing apparatus includes a control unit and an attaching unit. The control unit determines a position along a surface of a sheet adjacent to an edge portion thereof, where a tag including a binding section for binding the sheet is to be attached. The attaching unit has a carrier for the tag and is moved to attach the tag to the position on the surface of the sheet determined by the control unit.

14 Claims, 14 Drawing Sheets

(56) References Cited

U.S. PATENT DOCUMENTS

| | | | | |
|---|---|---|---|---|
| 2008/0025778 | A1 | 1/2008 | Ito et al. | |
| 2009/0002746 | A1 | 1/2009 | Niwa et al. | |
| 2009/0072974 | A1* | 3/2009 | Miyashita ..... | B65H 37/04<br>340/572.1 |

* cited by examiner

SHEET PROCESSING APPARATUS AND SHEET PROCESSING METHOD

CROSS-REFERENCE TO RELATED APPLICATION

This application is a continuation of U.S. patent application Ser. No. 15/394,318, filed Dec. 29, 2016, the entire contents of which are incorporated herein by reference.

FIELD

Embodiments described herein relate generally to a sheet processing apparatus and a sheet processing method.

BACKGROUND

An image forming system including a sheet processing apparatus, which performs processing on sheets, and an image forming apparatus, is known. An image forming system capable of reusing sheets is also known. The sheet processing apparatus performs, for example, hole punching in the sheets and binding together two or more sheets with a stapler. The sheets having the holes punched therein and the sheets bound by the stapler are unsuitable for reusing.

DETAILED DESCRIPTION

In general, according to one embodiment, a sheet processing apparatus includes a control unit and an attaching unit. The control unit determines a position along a surface of a sheet adjacent to an edge portion thereof, where a tag including a binding section for binding the sheet is to be attached. The attaching unit has a carrier for the tag and is moved to attach the tag to the position on the surface of the sheet determined by the control unit.

Figure 1:
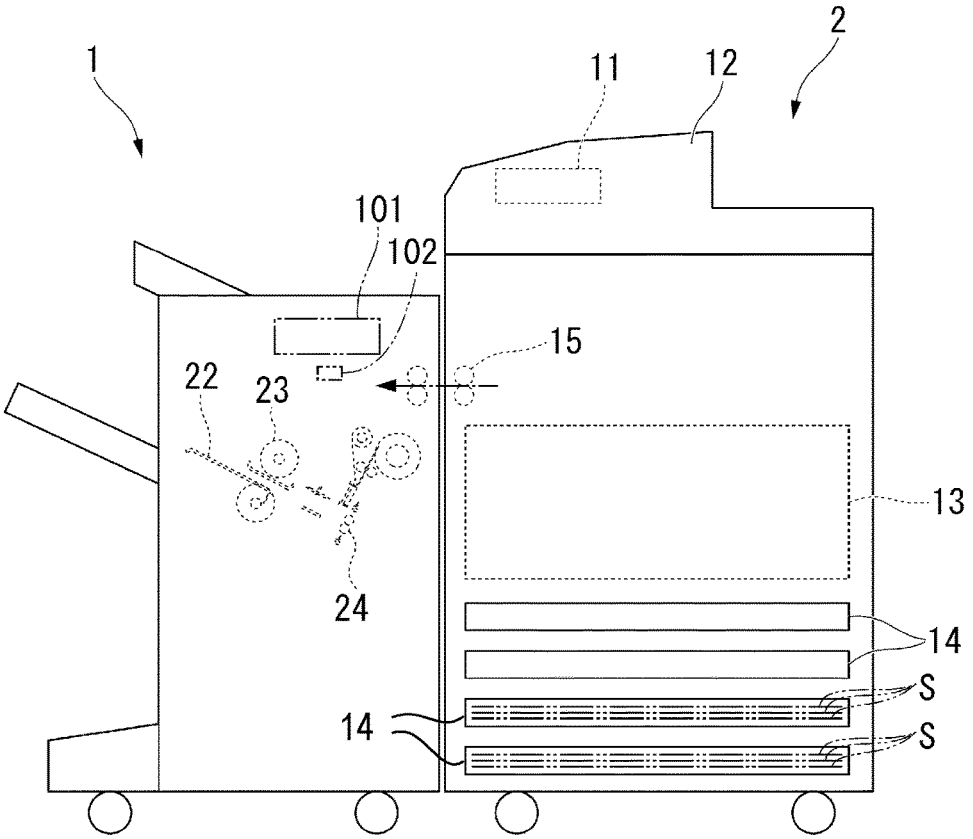
FIG. 1 is a front view of a sheet processing apparatus in an embodiment.
Figure 2:
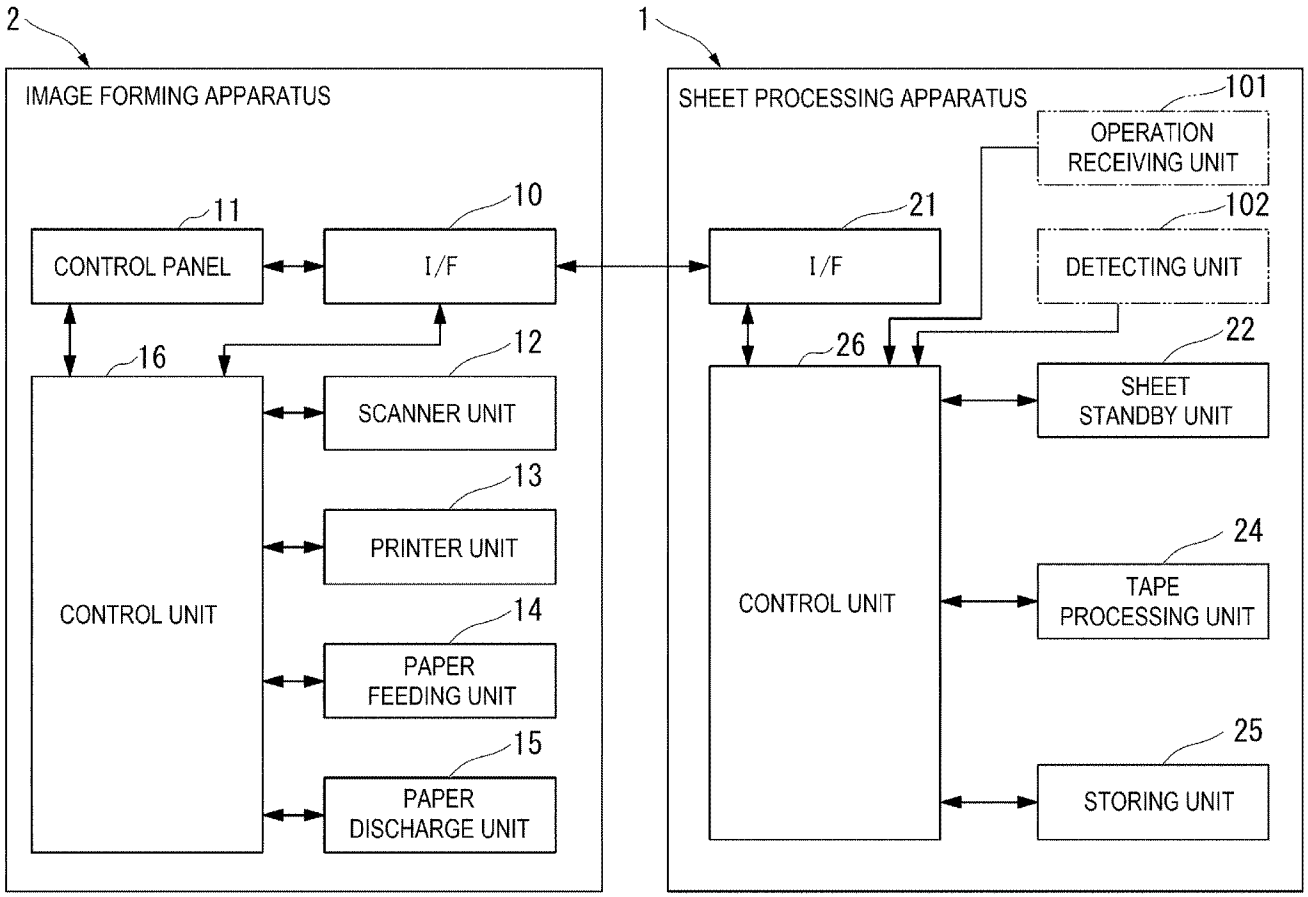
FIG. 2 is a diagram showing a system configuration of the sheet processing apparatus.

FIG. 1 is a front view of a sheet processing apparatus 1 of an embodiment. FIG. 2 is a diagram showing a system configuration of the sheet processing apparatus 1 of this embodiment. The sheet processing apparatus 1 of this embodiment is an apparatus that attaches a tag to an edge portion of a sheet. In this embodiment, an example is explained in which a tag is attached to one sheet.

The sheet processing apparatus 1 is disposed adjacent to an image forming apparatus 2. The sheet processing apparatus 1 performs post-processing on a sheet S conveyed from the image forming apparatus 2. Note that the sheet processing apparatus 1 is not limited to the example shown and may be an apparatus placed on, for example, a desk or a floor surface and used independently of the image forming apparatus 2.

As shown in FIGS. 1 and 2, the image forming apparatus 2 includes an interface 10, a control panel 11, a scanner unit 12, a printer unit 13, a paper feeding unit 14, a paper discharge unit 15, and a control unit 16.

The interface 10 is connected to an interface 21 of the sheet processing apparatus 1 by hardwire or wirelessly.

The control panel 11 includes various user selectable keys or touch panel selections and the like and receives operational inputs of a user. For example, when a tag is to be attached to a sheet S discharged from the image forming apparatus 2, the control panel 11 receives a user's operational inputs concerning the sheet S and an attachment position of the tag to the sheet S.

The control panel 11 receives, as the input by the user concerning the sheet S, for example, an input to select the thickness of the sheet S to be printed upon and an input to select a type of the sheet S to be printed upon. Note that "the type of the sheet S" in this embodiment includes a type classified by the material of the sheet S, the surface finish of the sheet S, or the like.

For example, the control panel 11 receives, as the input of the user concerning the attachment position of the tag, for example, an input for selecting one of a plurality of predetermined attachment location for one or more tags.

The image forming apparatus 2 sends information concerning the sheet S input by a user on the control panel 11 to the sheet processing apparatus 1 through the interface 10.

The scanner unit 12 reads image information of an image on a target object. The printer unit 13 forms an image on the sheet S on the basis of the image information received from the scanner unit 12 or image information received from an external apparatus through the interface 10. The paper feeding unit 14 supplies the sheet S to the printer unit 13. The paper discharge unit 15 conveys the sheet S, which is discharged from the printer unit 13, to the sheet processing apparatus 1.

The control unit 16 controls various kinds of operation of the interface 10, the control panel 11, the scanner unit 12, the printer unit 13, the paper feeding unit 14, and the paper discharge unit 15.

As shown in FIG. 2, the sheet processing apparatus 1 includes the interface 21, a sheet standby unit 22, a tape processing unit 24, a storing unit 25, and a control unit 26.

The control unit 26 comprises, for example, a control circuit including a CPU, a ROM, and a RAM provided in the sheet processing apparatus 1. For example, a processor such as the CPU executes a computer program, by which the control unit 26 controls the operation of the sheet processing apparatus 1. For example, the control unit 26 controls various kinds of operation of the sheet standby unit 22 and the tape processing unit 24.

The storing unit 25 is configured as, for example, a storage device provided in the sheet processing apparatus 1. Various computer programs and the like are stored in the storing unit 25.

The interface 21 acquires information concerning the sheet S by receiving the information from the image forming apparatus 2 as a part of a command. The interface 21 sends acquired various kinds of information to the control unit 26.

For example, the interface 21 acquires, as information concerning a number of sheets S to be printed upon, information concerning the thickness and the type of the sheets S. "The information concerning the thickness of the sheets S" is, for example, information indicating the thickness of a single sheet S. "The information concerning the type of the sheets S" is, for example, information indicating the type of material forming the sheet S. The sheet standby unit 22 and the tape processing unit 24 are explained below.

Figure 3:
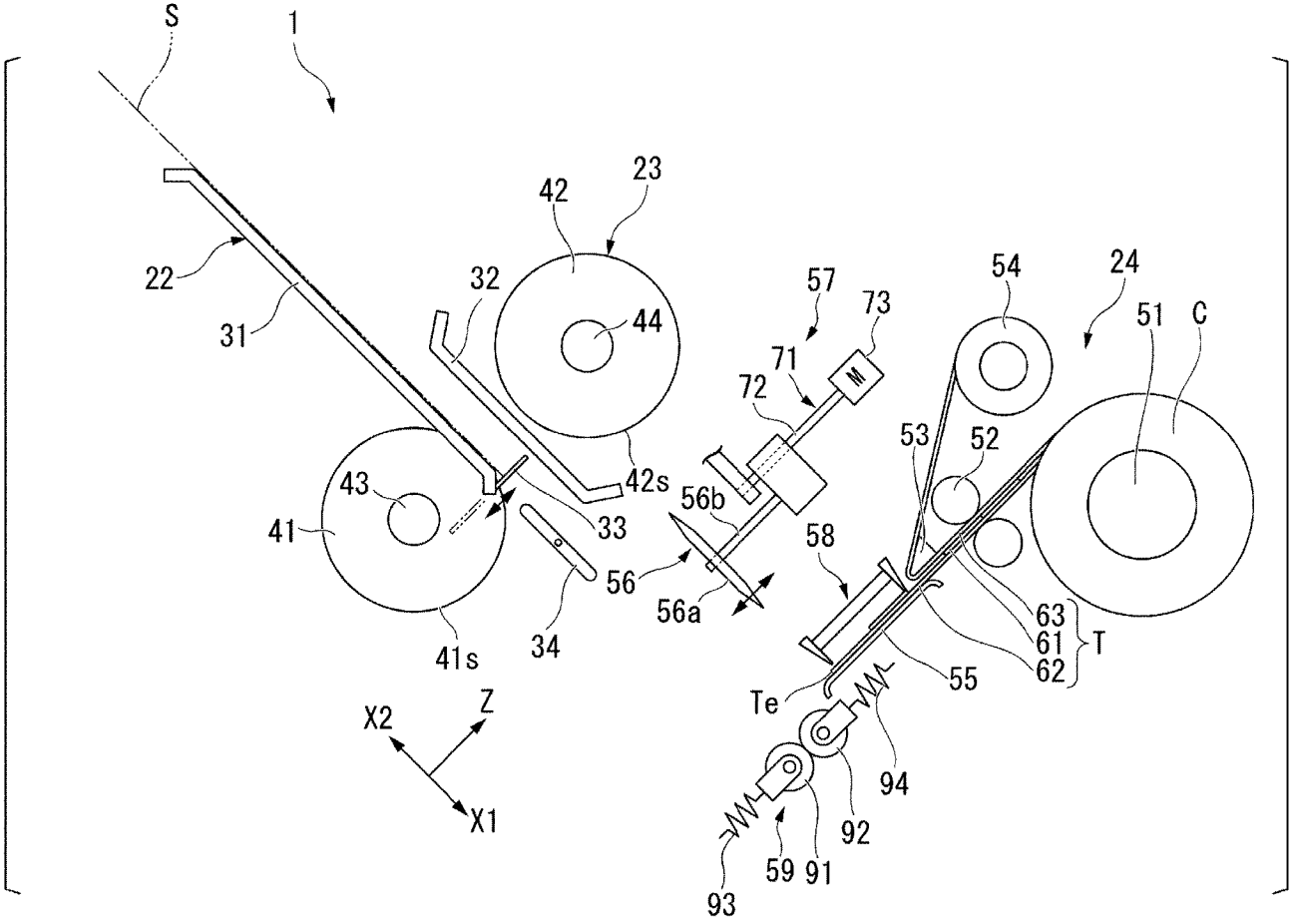
FIG. 3 is a front view partially showing the internal configuration of the sheet processing apparatus.

FIG. 3 is a front view partially showing the internal configuration of the sheet processing apparatus 1.

As shown in FIG. 3, the sheet standby unit 22 causes a sheet which is subjected to the tag attaching process, stand by or be held until additional sheets to be subjected to the tag attachment process, if any, are likewise received in the sheet standby unit 22. The sheet standby unit 22 includes a main guide 31, a sub-guide 32, a stop 33, and a switching member 34.

The main guide 31 guides the sheet S along a sheet conveying direction X1. A downstream side end portion of the main guide 31 in the sheet conveying direction X1 includes an opening therein into which a portion of a first roller 41 may extend.

The sub-guide 32 is opposed to the main guide 31 in a thickness direction Z of the sheet S (hereinafter referred to as sheet thickness direction Z). A space, in which the sheet S is stacked, is provided between the main guide 31 and the sub-guide 32. A downstream side end portion of the sub-guide 32 in the sheet conveying direction X1 also includes an opening therein into which a portion of a second roller 42 may extend.

The stop 33 is provided at the downstream side end portion of the main guide 31 in the sheet conveying direction X1. The stop 33 is capable of moving between a sheet holding position (indicated by a solid line in FIG. 3) and a sheet releasing position (indicated by the dash-dot-dot line in FIG. 3) with a not-shown moving mechanism. In the sheet holding position, the stop 33 projects above the upper surface of the main guide 31, and the downstream end portion in the sheet conveying direction X1 of the sheet S comes into contact with the stop 33 whereby the stop 33 holds the sheet S against further movement off the main guide 31. In the sheet releasing position, the stop 33 retracts below the upper surface of the main guide 31, and the stop 33 moves out of the travel path of the sheet and the sheet S on the main guide 31 passes to the switching member 34.

The switching member 34 switches the conveying path of the sheet S. In the following explanation, a direction in which the sheet S is conveyed toward the tape processing unit 24 (specifically, a tape attaching unit 59 explained below) is referred to as "first conveying direction". On the other hand, a direction in which the sheet S is conveyed toward a position (e.g., below the sheet standby unit 22) different from the tape attaching unit 59 is referred to as "second conveying direction". The switching member 34 switches the conveying path of the sheet S between the first conveying direction and the second conveying direction.

The first roller 41 is attached to a first shaft 43. The first roller 41 is a driving roller driven by a not-shown motor via the first shaft 43. The first roller 41 is rotatably supported in place. The material of the first roller 41 is not particularly limited. For example, the first roller 41 is formed of ethylene propylene diene rubber (EPDM).

The second roller 42 is attached to a second shaft 44. For example, the second roller 42 is a driven roller that rotates as a result of contact with the rotating first roller 41 or with a sheet therebetween. The second roller 42 is capable of moving, using a not-shown moving mechanism, in a direction toward the first roller 41 and a direction away from the first roller 41. The second roller 42 is capable of moving toward the first roller 41 to come into contact with the sheet S on the side thereof opposite to the first roller 41.

The tape processing unit 24 is explained below. The tape processing unit 24 includes an unwinding unit 51, a tape conveying unit 52, a separating member 53, a winding unit 54, a guide table 55, a cutter 56, a cutting-length changing unit 57, a tape holding unit 58, and the tape attaching unit 59.

The unwinding unit 51 holds a web roll wound with a belt-like tape T (hereinafter simply referred to as "tape T"). The unwinding unit 51 unwinds the tape T from the web roll along the length direction of the tape T.

Figure 4:
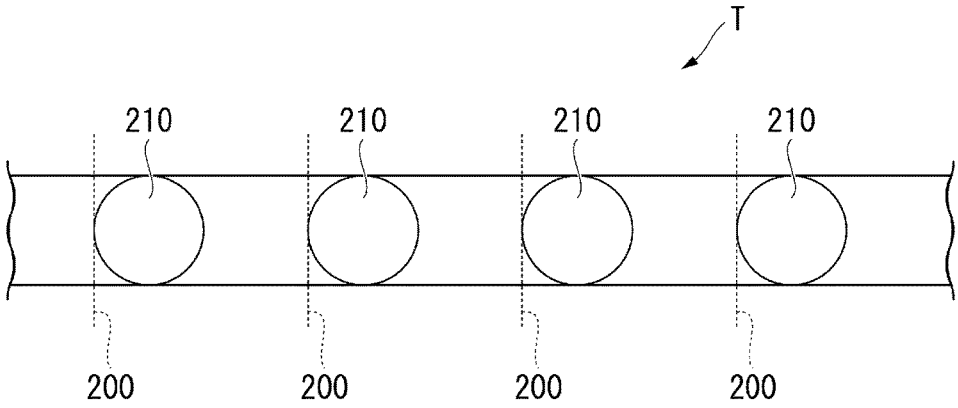
FIG. 4 is a diagram showing the front surface of a tape.
Figure 10:
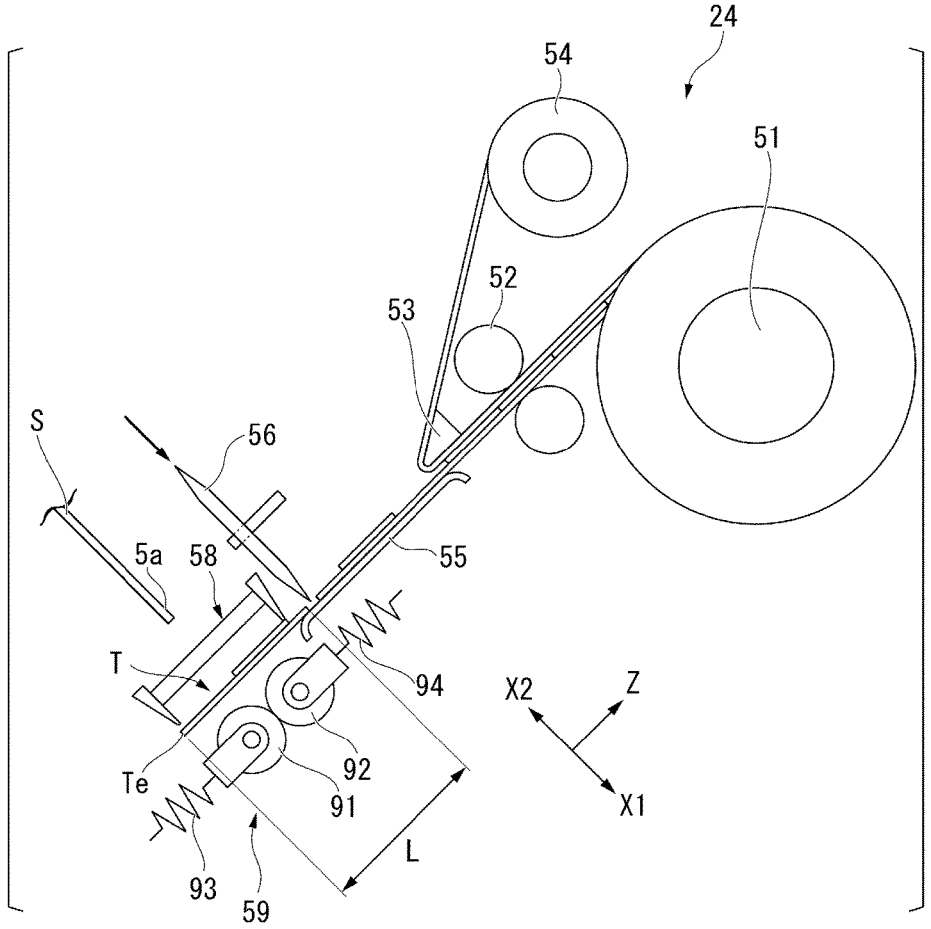
FIG. 10 is a front view showing the operation example of the sheet processing apparatus.

FIG. 4 is a diagram showing the front surface of the tape T in this embodiment. The tape T is cut at a cutting position 200 by the cutter 56 (FIG. 10). Holes 210 are formed extending through the tape T. The holes 210 are an example of binding sections. Each segment of cut tape T serves as a tag having one hole 210 therethrough. The holes 210 allow a sheet to be bound or held in a filing holder or the like, for example a binder having one or more rings, whereby a ring extends through the hole 210.

Figure 5:
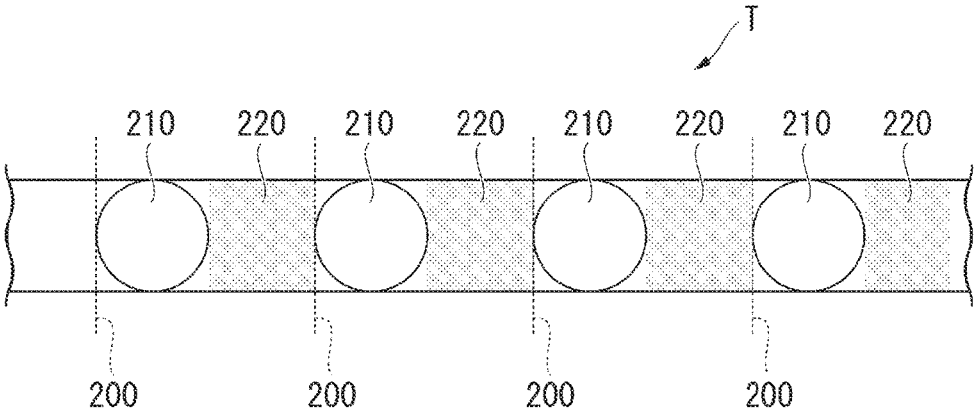
FIG. 5 is a diagram showing the rear surface of the tape.
Figure 14:
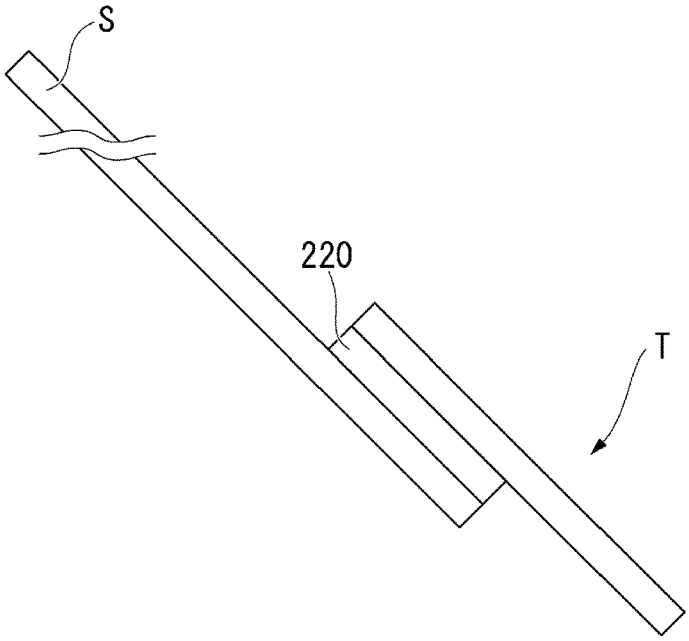
FIG. 14 is a diagram showing a state in which the tape is attached to a sheet.

FIG. 5 is a diagram showing the rear surface of the tape T in this embodiment. The sheet S is attached to the rear surface of the tape T. The tape T includes adhesive sections 220 for attaching tags to the sheet S. The adhesive sections 220 are not provided at a rectangular portion of the tape surrounding the holes 210. The adhesive sections 220 are provided on substantially half of the rear surface of each tag. When applied to a sheet, the adhesive sections 220 adhere to the surface of the sheet S adjacent to, and inwardly of, the edge of the sheet (FIG. 14). The tags when attached to the sheet S by the adhesive sections 220 can be removed by being peeled off (detached).

Figure 6:
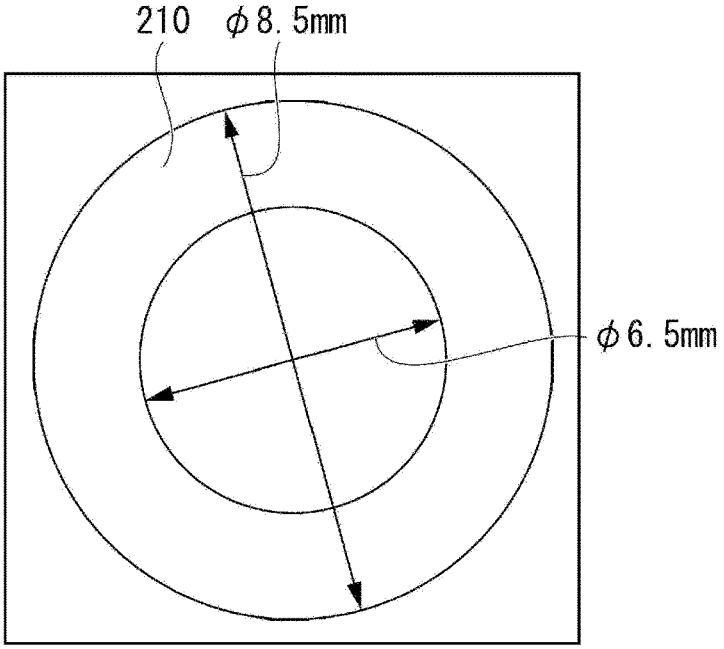
FIG. 6 is a diagram showing an example of a diameter of a hole.

FIG. 6 is a diagram showing an example of the diameter of the hole. The size of the hole which enables the sheet to be bound is selectable depending upon the construct of the binding portion of a filing holder. Therefore, holes 210 of a plurality of predetermined diameters, which are different from each other, can be provided through the tag. That is, the size of the hole can be adjusted. For example, as shown in FIG. 6, holes having a diameter of 8 mm and a diameter of 6.5 mm can extend through the tag, and a web roll of tape will typically have tape having only one hole 210 size, so that multiple web rolls of tape T can be used to provide the different hole 210 opening sizes.

As shown in FIG. 3, the tape T includes an adhesive layer 61, a protection film 62, also known as a carrier film, and a peelable film 63 in the state in which the tape T is held by the unwinding unit 51. The adhesive layer 61 is a layer which forms the adhesive sections 220. As explained above, the adhesive sections 220 are not provided on the entire length tape T, rather the adhesive sections 220 are provided at spaced fixed intervals. The protection film 62 covers the adhesive layer 61 on one side thereof. The protection film 62 is maintained with the adhesive layer 61 during use of the tape T. On the other hand, the peelable film 63 covers the adhesive layer 61 on the side of the adhesive layer opposite to the protection film 62. The peelable film 63 is peeled off from the adhesive layer 61 before the tape T is used. The peelable film 63 is separated from the adhesive layer 61 by the separating member 53 and is wound up by the winding unit 54.

The tape T is attached to the unwinding unit 51 in a state in which the tape T is wound in a cartridge C. The tape conveying unit 52 conveys the tape T, which is supplied from the unwinding unit 51, along the length direction of the tape T. For example, the length direction of the tape T is a direction substantially parallel to the sheet thickness direction Z. The guide table 55 guides the tape T from which the peelable film 63 was separated. The guide table 55 supports the tape T during holding and during cutting of the tape T.

The cutter 56 cuts the belt-like tape T supplied from the unwinding unit 51 and forms a tape T having a predetermined size. For example, the cutter 56 is a rotor cutter and includes a cutting blade 56*a* and a supporting shaft 56*b*. The supporting shaft 56*b* is rotated by a not-shown motor, whereby the cutting blade 56*a* is driven to rotate. Note that the configuration of the cutter 56 is not limited to the above example. The configuration of the cutter 56 may be any configuration as long as the cutter 56 can cut the tape T supplied from the unwinding unit 51. The cutter 56 is capable of moving, with a not-shown moving mechanism, in a direction toward the tape T and a direction away from the tape T.

The cutting-length changing unit 57 changes the length of the tape T cut by the cutter 56. Note that "the length of the tape" in this embodiment is the length of the tape T extending in the direction Z of the thickness of the sheet as positioned on the sub-guide 32. The length of the tape T to be cut depends on the desired size of the tag.

The cutting-length changing unit 57 includes a moving mechanism 71 that changes the position of the cutter 56 relative to a leading end Te of the tape T supplied from the unwinding unit 51. For example, the moving mechanism 71 moves the cutter 56 to change the position of the cutter 56 relative to the leading end Te of the tape T. For example, the moving mechanism 71 moves the cutter 56 in the direction Z of FIG. 3. Note that "the position of the cutter 56 relative to the leading end Te of the tape T" is, for example, a position of the cutter 56 relative to the leading end Te of the tape T at the time when the tape T is cut by the cutter 56.

In this embodiment, the moving mechanism 71 includes a supporting member 72 that supports the cutter 56 and a driving source 73 that moves the cutter 56 by moving the supporting member 72. For example, the supporting member 72 is a ball screw engaged will not-shown female threads of the cutter 56. The driving source 73 is a motor that rotates the ball screw to move the cutter 56. Note that the configurations of the supporting member 72 and the driving source 73 are not limited to the above examples. For example, the supporting member 72 may be a cam or the like set in contact with the cutter 56. The driving source 73 may be a solenoid or the like that moves the cutter 56 via the supporting member 72. In that case, the supporting member 72 is a coupling member that couples together the cutter 56 and the solenoid.

The configuration of the moving mechanism 71 is not limited to the above example. For example, the moving mechanism 71 may change the relative position of the cutter 56 relative to the leading end Te of the tape T by, for example, changing the unwound length of the tape T with respect to a fixed in place cutter 56. Note that a configuration in this case is explained below.

In this embodiment, the cutting-length changing unit 57 is controlled by the control unit 26 explained below. For example, the control unit 26 controls the driving source 73 of the cutting-length changing unit 57 to move the cutter 56 and change the length L of the tape T cut by the cutter 56. For example, the cutting-length changing unit 57 is controlled by the control unit 26, whereby the operation of the cutting-length changing unit 57 explained below is performed.

The tape holding unit 58 supports the tape T in a state in which the tape T is held substantially flat, in a planar disposition. The tape holding unit 58 is capable of moving along the length direction of the tape T by a not-shown moving mechanism. The tape holding unit 58 is capable of moving, with the not-shown moving mechanism, toward the tape T and away from the tape T.

The tape attaching unit 59 includes a first roller 91, a second roller 92, a first spring 93, and a second spring 94. The first spring 93 urges the first roller 91 toward the second roller 92. The second spring 94 urges the second roller 92 toward the first roller 91. The first roller 91 and the first spring 93 form an example of a "first urging unit" in cooperation with each other. The second roller 92 and the second spring 94 form an example of a "second urging unit" in cooperation with each other. When the tape T is attached to an edge portion 5*a* of the sheet S, the edge portion 5*a* is inserted between the first roller 91 and the second roller 92 together with the tape T. Consequently, the tape T is bent and wraps over the edge and portions of the sheet surface 5*a* adjacent to the edge of the sheet S by the tape attaching unit 59. The tape T is thus attached to the portion of the sheet surface 5*a* of the sheet S on one side of the sheet S.

An operation example of the sheet processing apparatus 1 is explained. FIGS. 7 to 13 are front views showing the operation example of the sheet processing apparatus 1.

First, as shown in FIG. 3, the sheet processing apparatus 1 moves the stop 33 to the sheet holding position to stop the sheet S conveyed by the main guide 31. Subsequently, the sheet processing apparatus 1 moves the stop 33 the sheet releasing position. The sheet processing apparatus 1 also switches the switching member 34 to direct the sheet S toward the second conveying direction.

Figure 7:
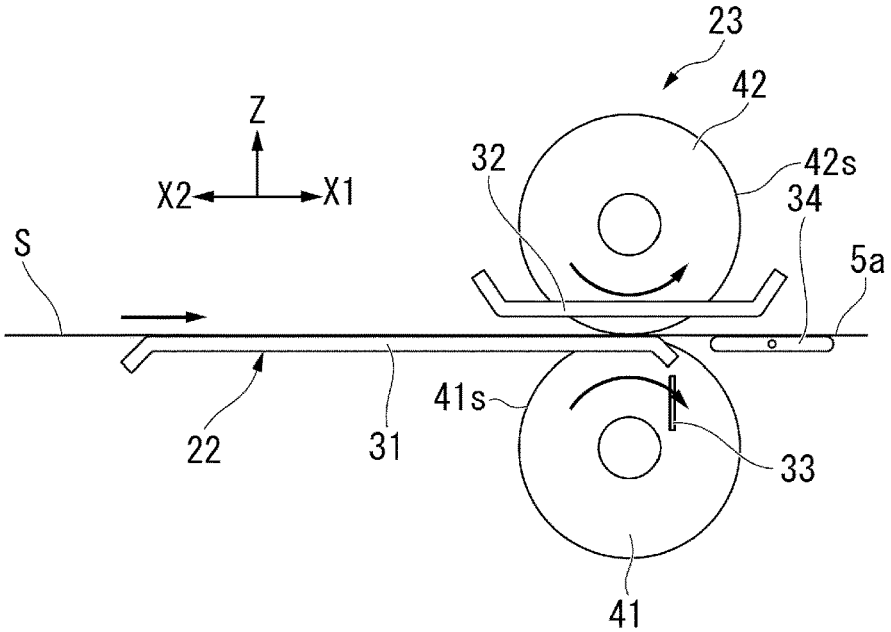
FIG. 7 is a front view showing an operation example of the sheet processing apparatus.

Subsequently, as shown in FIG. 7, the sheet processing apparatus 1 moves the second roller 42 toward the first roller 41. The sheet processing apparatus 1 switches the switching member 34 to switch the conveying path from the second conveying direction to the first conveying direction. The sheet processing apparatus 1 rotates the first roller 41 in the positive rotational direction of the arrow shown in FIG. 7 and thus the second roller 42 to move the sheet S toward the tape attaching unit 59.

Figure 8:
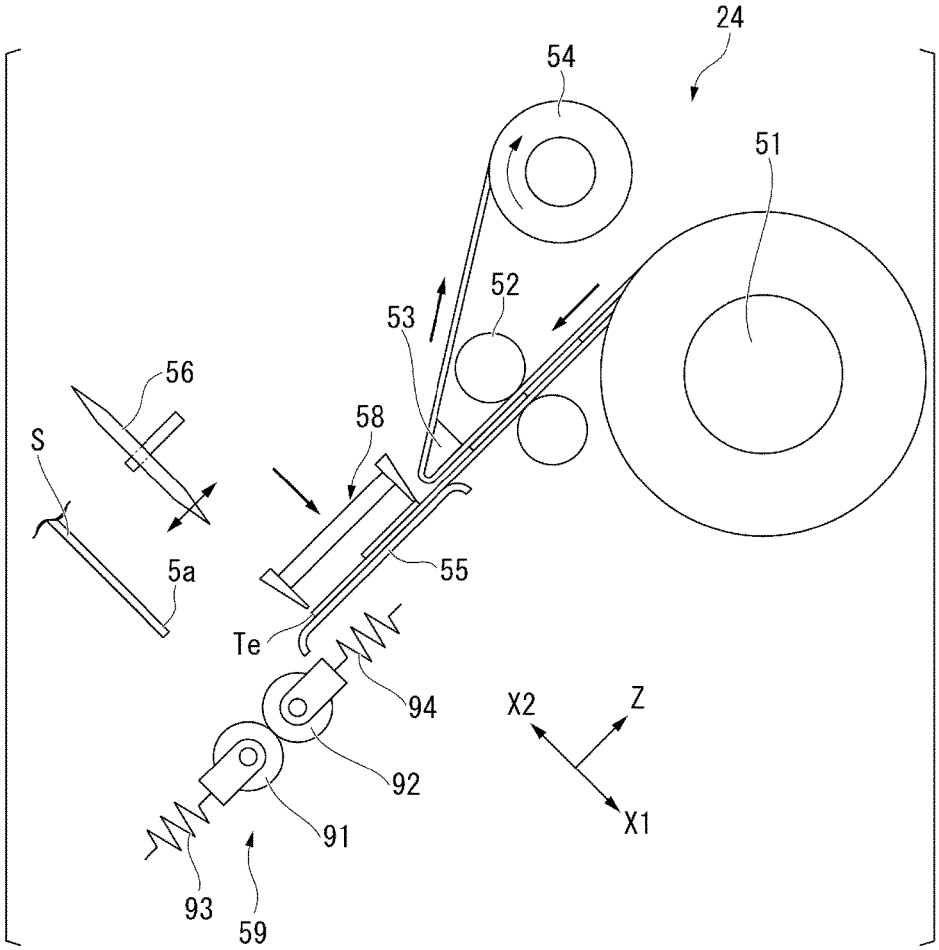
FIG. 8 is a front view showing the operation example of the sheet processing apparatus.
Figure 9:
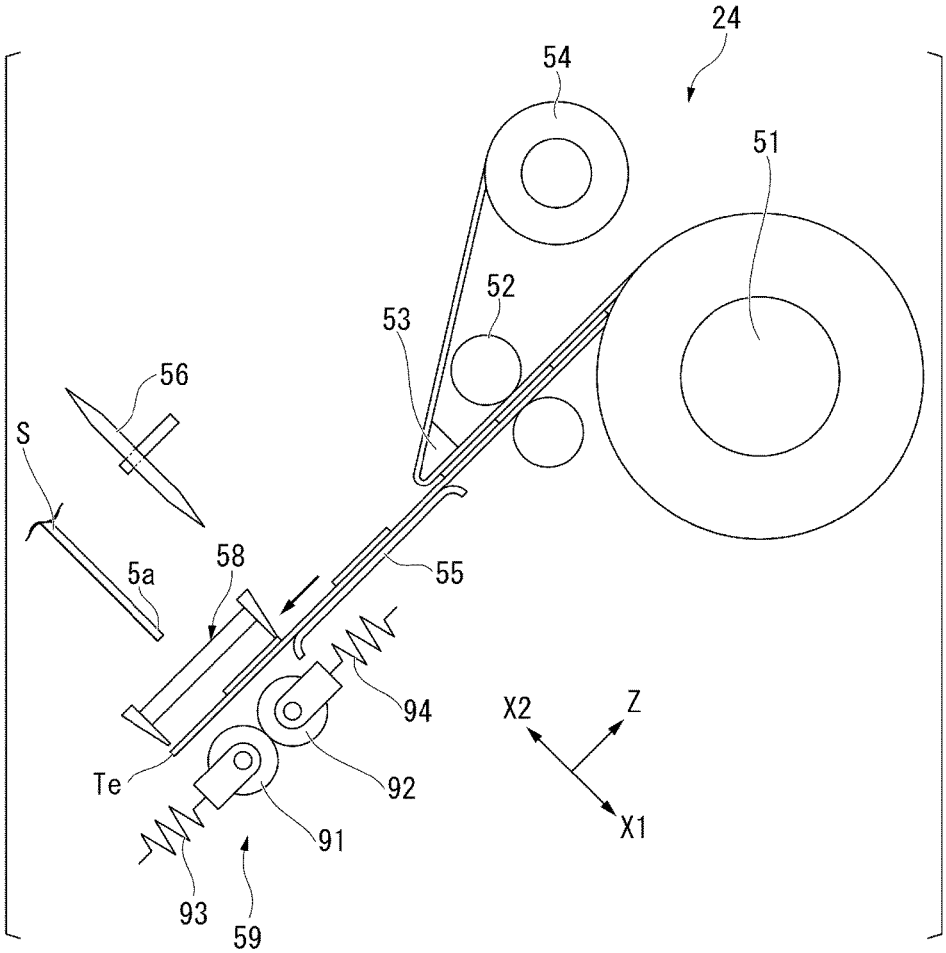
FIG. 9 is a front view showing the operation example of the sheet processing apparatus.

Subsequently, as shown in FIG. 8, the sheet processing apparatus 1 brings the tape holding unit 58 into contact with the tape T to support the tape T in a state in which the posture of the tape T is retained. As shown in FIG. 9, the sheet processing apparatus 1 then moves the tape holding unit 58 to a location between the sheet S and the tape attaching unit 59. For example, the tape holding unit 58 locates the tape T to span across the interface of the first roller 91 and the second roller 92. As shown in FIG. 10, the sheet processing apparatus 1 cuts the belt-like tape T using the cutter 56 and forms the tape T having a predetermined size. Consequently, the tape T is cut into a necessary length.

Figure 11:
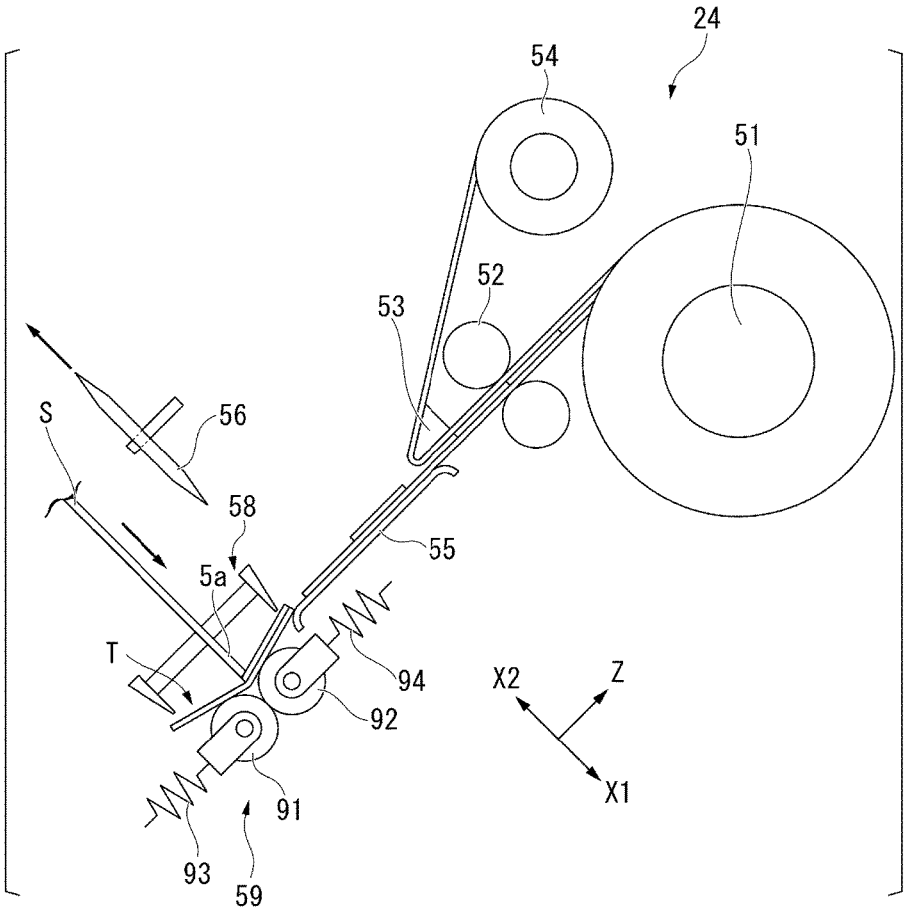
FIG. 11 is a front view showing the operation example of the sheet processing apparatus.

Subsequently, as shown in FIG. 11, for example, the sheet processing apparatus 1 rotates the first roller 41 in the positive rotational direction of the arrow shown in FIG. 7 and thus the second roller 42 to move the sheet S toward the tape attaching unit 59. The sheet processing apparatus 1 abuts the leading end of the edge portion 5*a* of the sheet S against the tape T. Consequently, the sheet processing apparatus 1 inserts the edge portion 5*a* of the sheet S between the first roller 91 and the second roller 92 together with the tape T.

Figure 12:
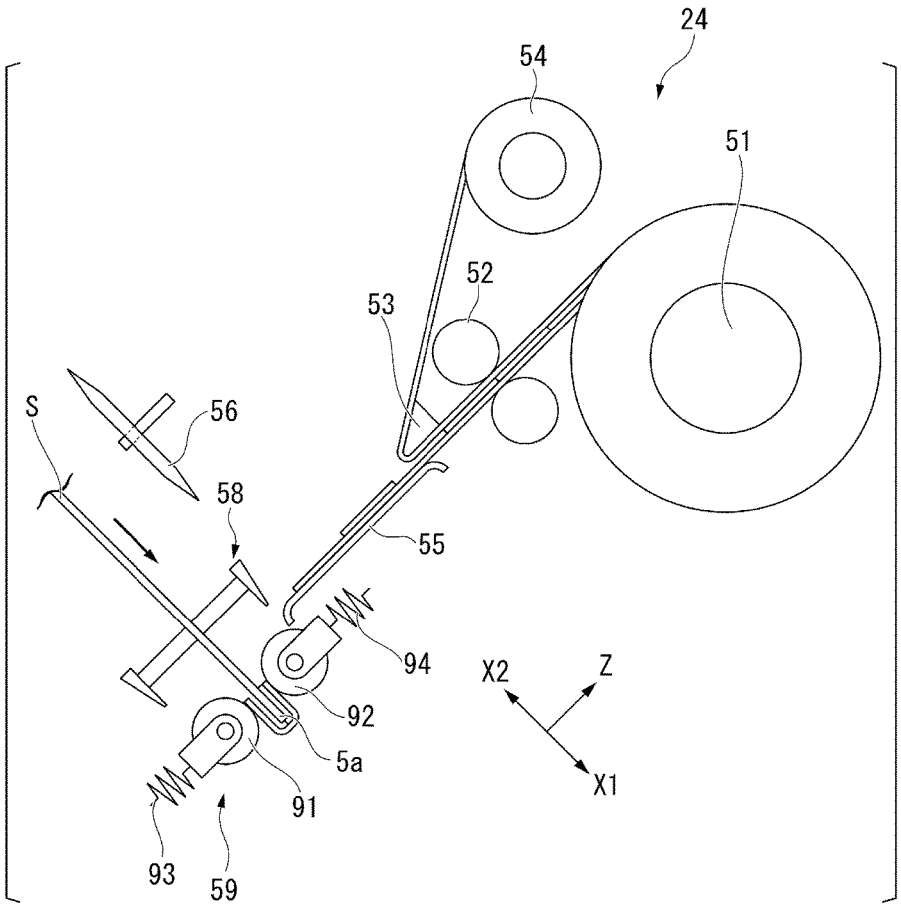
FIG. 12 is a front view showing the operation example of the sheet processing apparatus.

As shown in FIG. 12, the edge portion 5*a* of the sheet S is inserted between the first roller 91 and the second roller 92 together with the tape T. The first roller 91 and the second roller 92 move along the external shape of the edge portion 5*a* of the sheet S to thereby press the tape T against the edge portion 5*a* of the sheet S. Consequently, processing for attaching the tape T to the edge portion 5*a* of the sheet S is completed.

Figure 13:
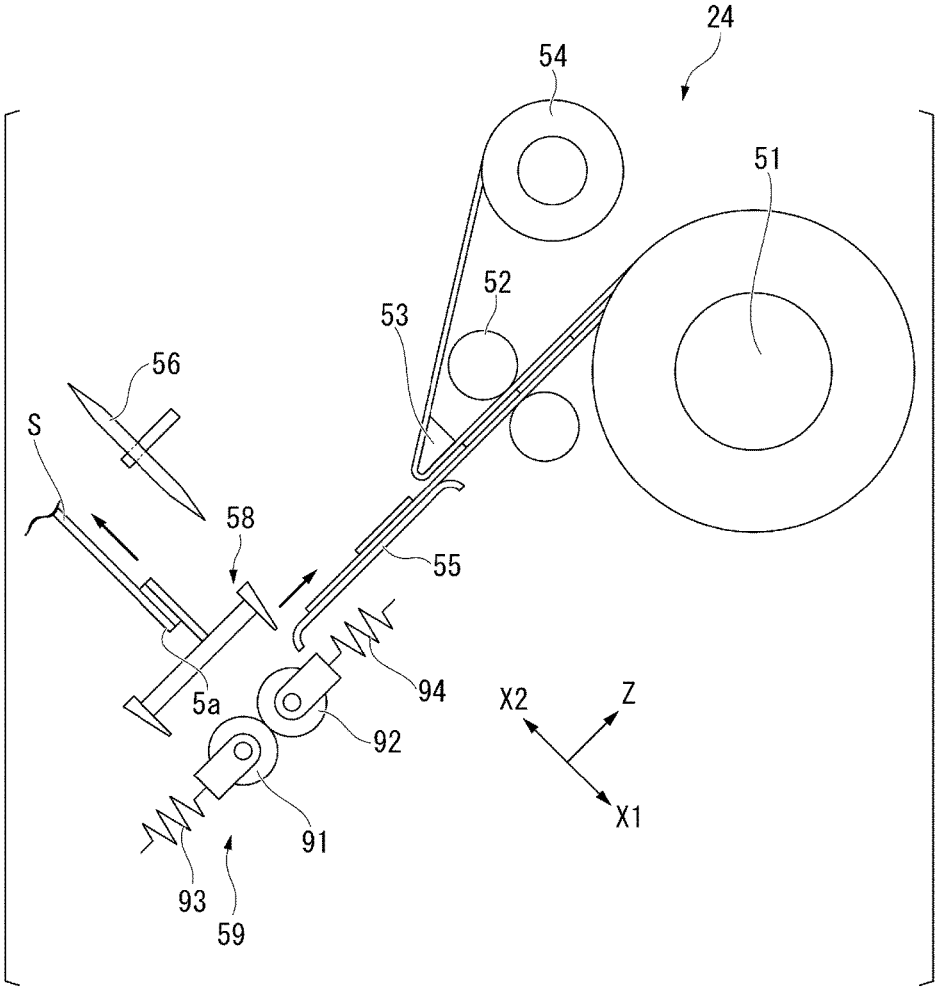
FIG. 13 is a front view showing the operation example of the sheet processing apparatus.

Subsequently, as shown in FIG. 13, the sheet processing apparatus 1 reversely rotates the first roller 41 and the second roller 42 to remove the sheet S from between the first roller 91 and the second roller 92. The sheet processing apparatus 1 further reversely rotates the first roller 41 and the second roller 42 to discharge the sheet S to a discharge unit of the sheet processing apparatus 1.

Consequently, the series of operations by the sheet processing apparatus 1 ends and the tape T (a tag) is attached to the sheet S.

FIG. 14 is a diagram showing the tape T as attached to the sheet S by the sheet processing apparatus 1. The tape T is attached to the sheet S by the adhesive section 220. Since a region where a hole is present does not include an adhesive section, the region where the hole is present does not stick to the sheet S. The sheet S may thus be bound in a filing holder using the hole 210 in the tape T attached to the sheet S in this way.

Figure 15:
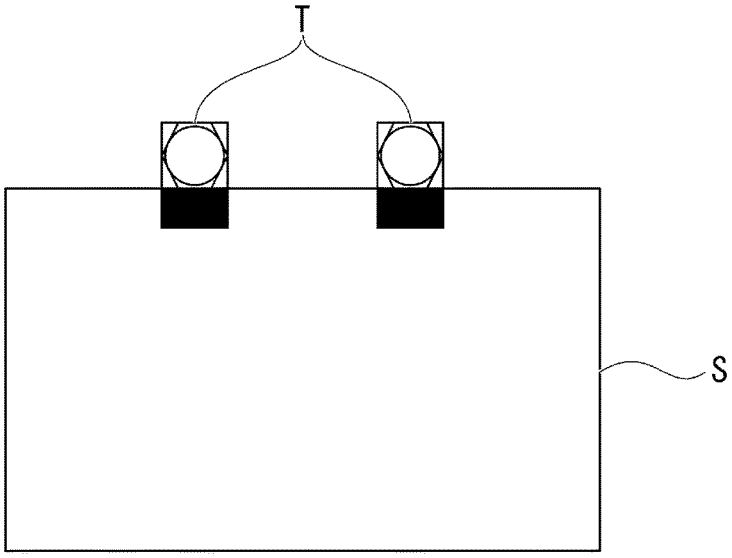
FIG. 15 is a diagram showing an attachment pattern of tags.
Figure 16:
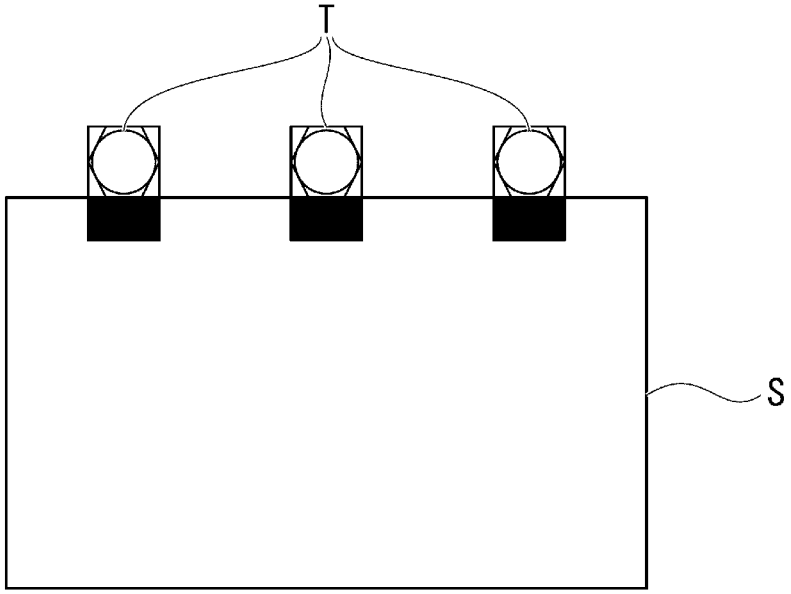
FIG. 16 is a diagram showing an attachment pattern of the tags.
Figure 17:
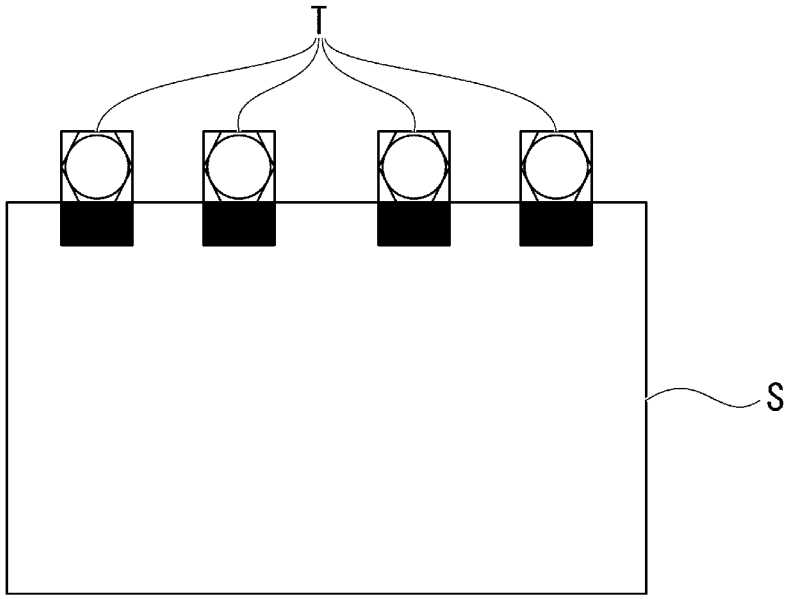
FIG. 17 is a diagram showing an attachment pattern of the tags.
Figure 18:
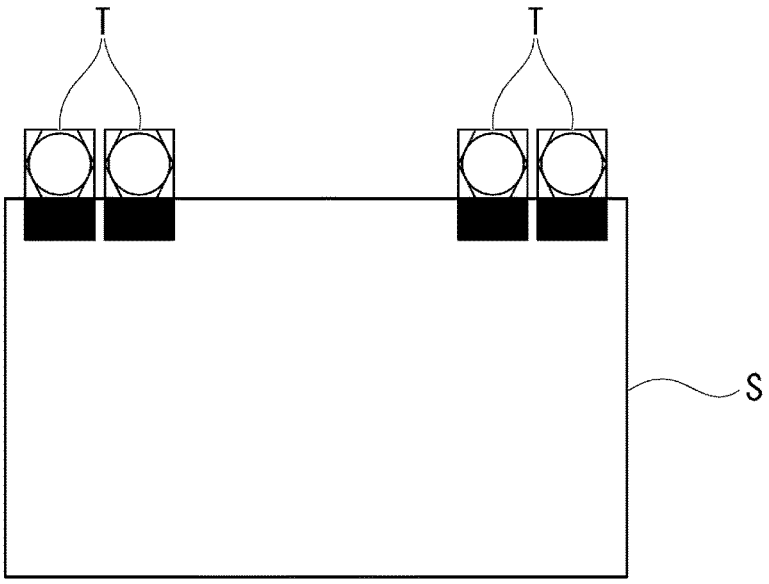
FIG. 18 is a diagram showing an attachment pattern of the tags.

FIGS. 15 to 18 are diagrams showing attachment patterns of tags. FIG. 15 is a diagram showing a two-hole attachment pattern. FIG. 16 is a diagram showing a three-hole attachment pattern. Both of FIGS. 17 and 18 show four-hole attachment patterns. The attachment pattern shown in FIG. 17 is an attachment pattern mainly used in France. The attachment pattern shown in FIG. 18 is an attachment pattern mainly used in Sweden.

If a pattern is selected by the user on the control panel 11, the control unit 26 determines, according to the pattern, positions of the sheet where the tags are to be attached. The sheet standby unit 22 and the tape processing unit 24 attach the tags to the predetermined positions of the sheet where tags are to be attached. As shown in FIGS. 15 to 18, the positions determined by the control unit 26 can be changed. Multiple tags may adhered to a sheet by providing a plurality of tape attaching units 59, moving the edge of the sheet S, the tape attachment unit(s) 59, or both, relative to one another and performing the insertion of the sheet S inwardly of the tape attachment unit to attach a tag, and removal of the sheet therefrom, multiple times.

The sheet processing apparatus 1 can flexibly attach the tags as shown in the attachment examples. In the above example, the attachment examples of the two to four tags are explained. However, the sheet processing apparatus 1 can also perform attachment of one tag or five or more tags.

In this embodiment, the tag is explained as an example of a binding section for a sheet to be bound in a binder, for example, a binder comprising one or more rings or other secure parts which extend through the holes to secure multiple sheets in a desired order. However, the binding sections are not limited to tags with holes 210. The binding sections may be, for example, rectangular regions of tape forming tags without holes. In this case, it is possible to bind the sheet by stapling the rectangular regions to a separate element.

Figure 19:
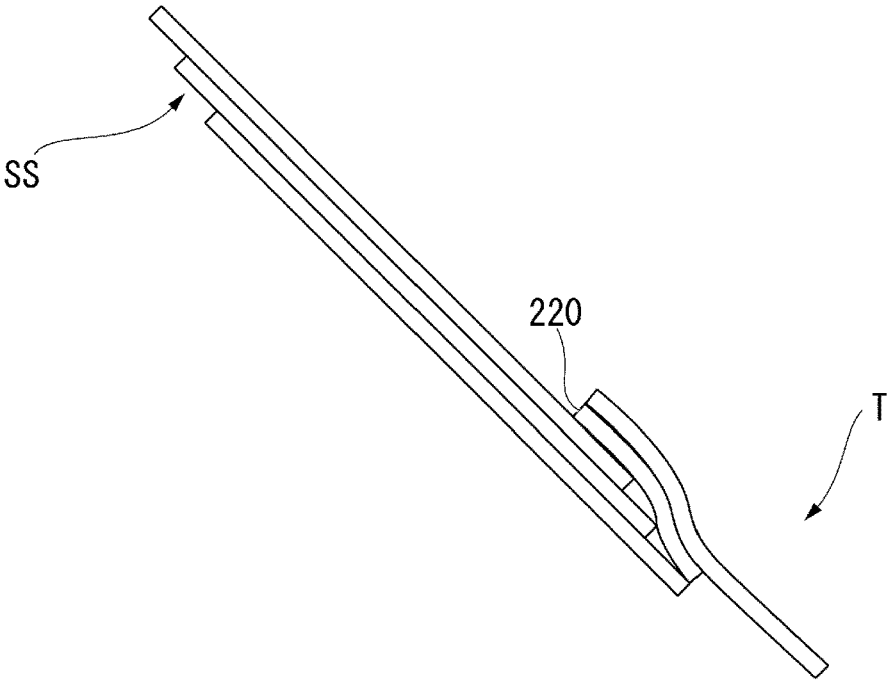
FIG. 19 is a diagram showing a state in which the tape is attached to a plurality of sheets.

Further, in this embodiment, one tag is attached to one sheet S. However, the number of sheets attached to a single tag is not limited to one. FIG. 19 is a diagram showing the tag attached to a plurality of sheets SS by the adhesive section 220 thereof. As shown in FIG. 19, by shifting the edges of the three sheets SS with respect to each other, the adhesive section 220 adheres to all three of the three sheets. In this way, the sheet processing apparatus 1 can attach one tag to a plurality of sheets.

By attaching the tag to the sheet, it is possible to bind the sheet without punching holes into the sheet or stapling the sheet. The tags attached to the sheet can be peeled off. Therefore, the sheet can be reused by peeling the tags off of the sheet.

Note that the configuration of the embodiment is not limited to the example explained above. For example, the sheet processing apparatus 1 may be an separate apparatus used independently of the image forming apparatus 2. In this case, the sheet processing apparatus 1 may include an u receiving unit 101 instead of the interface 21 (see FIGS. 1 and 2). The operation receiving unit 101 includes an operation panel and a switch and receives operational inputs of the user concerning the sheet S and the tape T. For example, the operation receiving unit 101 has a configuration and a function substantially the same as the configuration and the function of the control panel 11 of the image forming apparatus 2.

In the embodiment, the example is explained in which the first roller 41 actively rotates and the second roller 42 as a result of contact with the rotating first roller 41. However, the first roller 41 and the second roller 42 are not limited to this configuration. For example, both of the first roller 41 and the second roller 42 may rotate independently of each other.

According to the embodiment as explained above, by attaching the tags to the sheet, it is possible to bind the sheet and reuse the sheet. However, the embodiment is presented as an example and is not intended to limit the scope of the invention. The embodiment can be implemented in other various forms. Various omissions, substitutions, and changes can be made without departing from the spirit of the invention. This embodiment and modifications of the embodiment are included in the scope and the gist of the invention and included in the inventions described in claims and the scope of equivalents of the inventions.

What is claimed is:

1. A sheet processing apparatus comprising:

a sheet tagging section; and a conveying section to convey at least one sheet toward the sheet tagging section, wherein the sheet tagging section includes a supply, in strip form, of a carrier on which an adhesive is selectively disposed, with regions along the carrier in which adhesive is not present located between regions where adhesive is disposed;

a cutter selectively engagable with the carrier to cut through the carrier and singulate a tag comprising a portion of carrier on which adhesive is present and a portion of carrier where adhesive is not present; and a tag attaching portion comprising a pair of rollers engageable with each other, wherein, when the edge of at least one sheet is conveyed by the conveying section into contact with the tag, the adhesive section of the tag is interposed between a surface of the sheet and one of the rollers.

2. The sheet processing apparatus of claim 1, wherein the portion of the tag where no adhesive is present on the carrier includes a hole extending therethrough.

3. The sheet apparatus according to claim 1, wherein the hole has a predetermined diameter selected from a plurality of predetermined possible hole diameters.

4. The sheet processing apparatus according to claim 1, further comprising:

a control unit configured to determine a position along the surface of the sheet adjacent to the edge thereof, where the tag is to be attached.

5. The sheet processing apparatus according to claim 4, wherein the control unit changes the position where the tag is to be attached based on an input of a user.

6. The sheet processing apparatus according to claim 4, further comprising:

a sheet standby unit configured to temporarily hold multiple sheets, wherein the sheet tagging section singulates a tag a multiple number of times, and attaches the singulated tags one at a time to a different one of the multiple sheets at the position determined by the control unit.

7. The sheet processing apparatus according to claim 6, wherein the sheet standby unit shifts the edges of the sheets thereon relative to each other before conveying one of the sheets towards the sheet tagging section.

8. The sheet processing apparatus according to claim 7, wherein the sheet standby unit includes a main guide that supports the sheets on an inclined surface thereof, a sub-guide opposing the main guide, and a stop against which the sheets supported on the inclined surface of the main guide abut.

9. The sheet processing apparatus according to claim 8, wherein the stop is movable to a position that allows one of the sheets to be conveyed towards the sheet tagging section.

10. The sheet processing apparatus according to claim 1, wherein the tag, after being attached to the sheet, can be peeled from the sheet without damaging the sheet.

11. The sheet processing apparatus according to claim 1, wherein the conveying section comprises a pair of rollers, one of which is driven in a first rotational direction when the sheet is conveyed towards the tag attaching portion and driven in a second rotational direction after the tag is attached to the sheet.

12. The sheet processing apparatus according to claim 11, wherein the tag is in a folded state when the conveying section reverses a conveying direction of the sheet.

13. The sheet processing apparatus according to claim 12, wherein the tag in the folded state has first and second parts that sandwich the edge of the sheet that is in contact with the adhesive section of the tag.

14. The sheet processing apparatus according to claim 13, wherein the adhesive section of the tag is between the first part of the tag and the surface of the sheet.

* * * * *